US005363812A

United States Patent [19]

Belin et al.

[11] Patent Number: 5,363,812

[45] Date of Patent: Nov. 15, 1994

[54] METHOD AND APPARATUS FOR CONTROLLING THE BED TEMPERATURE IN A CIRCULATING FLUIDIZED BED REACTOR

[75] Inventors: Felix Belin, Brecksville; Kiplin C. Alexander, Wadsworth; David E. James, Barberton, all of Ohio

[73] Assignee: The Babcock & Wilcox Company, New Orleans, La.

[21] Appl. No.: 198,694

[22] Filed: Feb. 18, 1994

[51] Int. Cl.[5] ..... F22B 1/00

[52] U.S. Cl. ..... 122/4 D; 110/245; 165/104.16; 422/145

[58] Field of Search ..... 122/4 D; 110/245, 263; 165/104.16; 422/145, 146

[56] References Cited

U.S. PATENT DOCUMENTS

| | | | |
|---|---|---|---|
| 2,083,764 | 6/1937 | Weisgerber | 183/110 |
| 3,759,014 | 6/1973 | Van Dyken et al. | 55/96 |
| 4,165,717 | 8/1979 | Reb et al. | 122/4 D |
| 4,253,425 | 3/1981 | Gamble et al. | 122/4 D |
| 4,532,287 | 8/1985 | Van Gasselt et al. | 110/216 |
| 4,538,549 | 8/1985 | Strömberg | 122/4 D |
| 4,589,352 | 5/1986 | Van Gasselt et al. | 110/216 |
| 4,640,201 | 2/1987 | Holmes et al. | 110/245 |
| 4,672,918 | 6/1987 | Engstrom et al. | 122/4 D |
| 4,679,511 | 7/1987 | Holmes et al. | 110/216 |
| 4,683,840 | 8/1987 | Morin | 122/4 D |
| 4,699,068 | 10/1987 | Engström | 110/216 |
| 4,708,092 | 11/1987 | Engström | 122/4 D |
| 4,717,404 | 1/1988 | Fore | 55/444 |
| 4,730,563 | 3/1988 | Thornblad | 110/216 |
| 4,732,113 | 3/1988 | Engström | 122/4 D |
| 4,770,237 | 9/1988 | Morin et al. | 165/104.16 |
| 4,891,052 | 1/1990 | Belin et al. | 55/429 |
| 4,915,061 | 4/1990 | Garcia-Mallol | 122/4 D |
| 4,962,711 | 10/1990 | Yamauchi et al. | 122/4 D X |
| 4,992,085 | 2/1991 | Belin et al. | 55/444 |
| 5,025,755 | 6/1991 | Eickvonder et al. | 122/4 D |
| 5,060,599 | 10/1991 | Chambert | 122/4 D |
| 5,159,886 | 11/1992 | Schaub et al. | 122/4 D X |
| 5,218,932 | 6/1993 | Abdulally | 122/4 D |

FOREIGN PATENT DOCUMENTS 349915 6/1931 United Kingdom .

OTHER PUBLICATIONS

"Coal-fired CFB boilers with an Alternate Particle Collector" Alexander & Walker, Presented to Pittsburgh Coal Conference, Pittsburgh, Pa., Sep. 10-14, 1990, Entire Paper.

"Coal-Fired Boilers-Babcock & Wilcox's Experience," Belin, Price & Warrick-Presented to International Joint Power Generation Conference, San Diego, Calif., Oct. 6-10, 1991 Entire Paper.

(List continued on next page.)

*Primary Examiner*—Edward G. Favors

*Attorney, Agent, or Firm*—Robert J. Edwards; Eric Marich

[57] ABSTRACT

Bed temperature in a circulating fluidized bed (CFB) reactor is controlled by varying a recirculation rate of particles collected by a secondary particle separator back to the CFB reactor. Particle storage means, sized to contain sufficient inventory required for bed inventory/temperature control due to fuel/sorbent variations and/or load changes, stores particles collected by the secondary particle separator. The storage means can be either directly below the secondary particle separator or at a remote location. Particles collected by the secondary particle separator rather than by the primary particle separator are preferred due to their smaller size and lower temperature. A bed temperature control system controls the recirculation rate of these particles back to the reactor. Level sensing devices are provided on the storage means. A solids storage level control system that interacts with the bed temperature control system controls the solids inventory in the storage means via a purge system.

22 Claims, 7 Drawing Sheets

FOREIGN PATENT DOCUMENTS

"Circulating Fluidized Bed Boiler, Design Refinements", Walker, Presented to Council of Industrial Boiler Owners, Fluid Bed VII Seminar, Indianapolis, Ind., Dec. 8-10, 1991 20 pages.

"Clean Energy for the World", Belin & Flynn-Circulating Fluidized Bed Boiler Solids System with in--Furnace Particle Separator Proceedings of the 1991 International Conference on Fluidized Bed Combustion, Montreal, Canada, Apr. 21-24, 1991 pp. 287-294.

"Coal & Waste Coal-Fired CFB Boilers Accumulate Operating Experience," Price & Walker, Presented to 12th International Conference on Fluidized Bed Combustion, May 8-13 1993, La Jolla, Calif., Entire Paper.

"Waste Wood Combustion in Circulation Fluidized Bed Boilers" Belin, James, Warrick, Presented to Second International Conference on Circulating Fluidized Beds, Mar. 14-18, 1988, Compaigne, France, Entire Paper.

"Lauhoff Grain Coal-Fired CFB Boiler-Design Start-Up & Operation," Belin, James, Kraft, Schaper, Presented to Intl. Joint Power Generation Conference, Boston, Mass., Oct. 21-25, 1990 Entire Paper.

"Design & Construction of the Lauhoff Grain CFB Cogeneration Project" Johns, Presented to Kentucky Industrial Coal Conference, University of Kentucky, Lexington, Ky., Apr. 12-13, 1989 Entire Paper.

"2.5 MWth Circulating FBC Research Facility; Design & Start Up Experiences" Hooper & Flynn, Presented to American Power Conference, Chicago, Ill., Apr. 23-25, 1990 Entire Paper.

"Foster Wheeler's Answer to Meeting the Challenge; Large Scale CFB Unit Design for the Electric Utility Market" Abdulally & Cox, Perrysville, N.J., entire Paper Date Unknown.

"Update of Waste Fuel Firing Experience in Foster Wheeler Circulating Fluidized Bed Boilers", Abdullay & Navazo Presented at Power-Gen '93 Asia, Singapore, Sep. 13-15, 1993 & Power-Gen '93 Americas, Dallas, Tex., Nov. 11-19, 1993 Entire Paper.

"An Update of Operational Experiences at NISCO" Voyles & Zierold Presented at Power-Gen Americas, '93, Nov. 17-19, 1993 & CIBO Fluidized IX, Bakersfield, Calif., Dec. 7-8, 1993 Entire Paper.

METHOD AND APPARATUS FOR CONTROLLING THE BED TEMPERATURE IN A CIRCULATING FLUIDIZED BED REACTOR

FIELD OF THE INVENTION

The present invention relates, in general, to circulating fluidized bed (CFB) reactors or combustors and, more particularly, to a method and apparatus for controlling a bed temperature of a CFB reactor or combustor. The present invention accomplishes this result by controlling a recirculation rate of particles collected by a secondary particle separator and transferred from a storage means for same into the CFB reactor.

BACKGROUND OF THE INVENTION

CFB reactors or combustors used in the production of steam for industrial process requirements and/or electric power generation are well known in the art. FIGS. 1, 2, and 3 illustrate various known CFB designs. A CFB reactor or combustor, generally referred to as 1, is shown therein. Fuel 2 and sorbent 4 are supplied to a bottom portion of a reactor enclosure or furnace 6 contained within enclosure walls 8, which are normally fluid cooled tubes. Air 10 for combustion and fluidization is provided to a windbox 12 and enters the furnace 6 through apertures in a distribution plate 14. Flue gas containing entrained particles or solids 16 (reacting and non-reacting particles) flows upwardly through the furnace 6, releasing heat to the enclosure walls 8. In most designs, additional air is supplied to the furnace 6 via overfire air supply ducts 18. A bed drain purge 19 is also provided.

Both reacting and non-reacting solids are entrained in the flue gas within the furnace 6, and the upward gas flow carries these solids to an exit at an upper portion of the furnace 6. There, a portion of the solids are collected by a primary particle separator 20 and returned to a bottom portion of the furnace 6 at a controlled or non-controlled flow rate. The collection efficiency of the primary particle separator 20 is commonly not sufficient for the retention of particles in the furnace 6, as required for efficient performance and/or for the required reduction of the solids content in gases discharged to the atmosphere. For this reason additional particle separators are installed downstream of the primary particle separator 20.

Referring to FIG. 1, in one known CFB reactor arrangement a secondary particle separator 22 and its attendant solids recirculation means 24 are installed to collect and recycle particles passing the primary particle separator 20 as needed for efficient CFB operation. The gases and solids release heat to convection heating surfaces 26 located between the primary and secondary particle separators 20, 22, respectively. A final or tertiary particle separator 28 is provided downstream (with respect to the flow of flue gas and entrained particles 16) of the secondary particle separator 22 for final gas cleaning to meet particulate emission requirements. A purge system 30 may be employed to purge solids collected from the flue gas by the secondary particle separator 22.

In another arrangement, shown schematically in FIG. 2, the secondary particle separator 22 is the final particle separator. In this case, to improve the particle retention as needed for efficient CFB furnace 6 performance, the solids or particles collected by the secondary particle separator 22 may be partially recirculated through the recycle transport line 24 to a lower portion of the CFB reactor 6. A purge system 30 purges solids collected from the flue gas by the secondary particle separator 22.

When solids recirculation from the secondary particle separator 22 is needed for efficient unit operation, the rate of recirculation corresponds to the CFB system material balance with a given solids input flow and is a function of the physical characteristics of the solids and efficiencies of the primary and secondary particle separators 20, 22 respectively, and limits or targets imposed on the recirculation rate by one of the following: a) the capacity of the solids recirculation means 24; b) the maximum acceptable solids loading through the convection heating surface 26 downstream of the primary particle separator 20; c) the flow rate that provides the optimum CFB reactor performance (in terms of combustion efficiency, sorbent utilization, convection surface erosion, operating and/or maintenance cost of the solids recirculation system) and d) the low limit of the bed temperature in the CFB furnace 6.

When the solids recirculation rate from the secondary particle separator 22 is restricted as compared to that rate which would otherwise be obtained as determined by the material balance due to one of the limits described above, the excess of circulating solids is removed from the secondary particle separator 22 for disposal through the purge system 30, shown in FIGS. 1 and 2, to accommodate the recirculation rate limitation.

In known systems a minimal solids inventory is maintained in a secondary particle separator hopper 32 by controlling the purge rate through purge system 30. In these systems, an increase in the flow rate of solids recirculated from the secondary particle separator 22 to increase the solids inventory in the CFB reactor 1 can only be done slowly. The rate of the recirculated flow (and inventory) increase is dictated by the change of the secondary particle collector purge flow rate, which is reduced to zero when the recirculation flow starts to increase. In FIG. 1 systems, this purge flow rate is typically not more than 10% of the recirculation flow, and the rate of recirculation flow increase is insufficient for responsive reactor inventory control.

FIG. 3 schematically shows a known CFB reactor or boiler system of the type disclosed in U.S. Pat. No. 4,538,549 to Strömberg. In this system, the bed temperature in the CFB reactor furnace 6 is controlled by changing the inventory of circulating solids in the furnace 6 by regulating the circulation rate of solids collected by the primary particle separator 20 and stored in a primary particle storage hopper 34 placed underneath the primary particle separator 20. The mass of solids in primary particle storage hopper 34 is varied depending on CFB reactor control requirements. When more inventory is needed in the furnace 6 to reduce the bed temperature, the solids circulation rate through a standpipe and non-mechanical L-valve 36 connecting the primary particle storage hopper 34 with the bottom portion of the reactor enclosure or furnace 6, is increased. A part of the stored bed material is thus transferred to and becomes part of the furnace 6 inventory. When the CFB reactor inventory is to be decreased, the opposite action takes place which results in solids accumulating in the primary particle storage hopper 34.

In the CFB system shown in FIG. 3, the flow rate of solids recirculated from the secondary particle separator 22, is "uncontrolled but selfadjusting" (per Col. 7, lines 16–19 of U.S. Pat. No. 4,538,549) as determined by the material balance. However, operational experience with the CFB system reactor or boiler and control method of U.S. Pat. No. 4,538,549 has shown the following shortcomings:

a) transport of solids stored in the primary particle storage hopper 34 in the packed bed regime causes flowability problems due to the tendency of the particles in a packed bed to agglomerate at temperatures of about 1600° F., which is typical for fluidized bed combustion applications; and
b) the hot particle storage, transfer, and control means required to accomplish this control method represent a considerable cost and contribute to the complexity of the CFB design.

An improved CFB reactor has been suggested (U.S. patent application Ser. No. 08/037,986, filed Mar. 25, 1993, assigned to The Babcock & Wilcox Company) in which solids are collected by an entirely internal primary particle separator which also returns particles collected thereby internally and directly to a bottom portion of the CFB reactor. This improved CFB reactor thus eliminates the need for any external recirculation means such as standpipes and L-valves, which considerably simplifies the CFB reactor arrangement and reduces its cost. A disadvantage of this concept as compared with that of U.S. Pat. No. 4,538,549 is that it does not provide for control of the bed temperature by controlling inventory of the circulating material in a CFB reactor via regulating the solids recirculation rate from the primary separator.

It is thus apparent that a need exists for a method and apparatus for controlling a bed temperature in a CFB reactor or combustor that does not rely upon controlled recirculation of particles collected by a primary particle separator.

SUMMARY OF THE INVENTION

The present invention accomplishes these objectives as well as others by controlling the inventory of circulating material in a CFB reactor in a unique manner. Instead of controlling a recirculation rate of solids from the primary particle separator back to the CFB reactor, the present invention controls the recirculation rate of solids collected by a secondary particle separator, transferring the solids inventory between a storage means for solids collected by the secondary particle separator and the CFB reactor.

The solids recirculation rate is controlled by a bed temperature control system which changes the furnace inventory to maintain the furnace temperature at a target level. The target furnace temperature value is determined as a function of CFB reactor load. The furnace inventory is adjusted depending upon the difference between actual and target bed temperature. Changes in furnace inventory are accomplished by transferring solids between the furnace and the secondary particle separator storage means.

Thus, one aspect of the present invention is drawn to a circulating fluidized bed reactor having an enclosure for containing and conveying a circulating fluidized bed of material, said enclosure having a lower portion and an upper portion. A primary particle separator means is provided for collecting particles entrained within a gas flowing through and from said reactor enclosure. Means are provided for returning the particles collected by said primary particle separator means back to the lower portion of said reactor enclosure. Secondary particle separator means are provided for further collecting particles entrained and still remaining within the gas flowing from said reactor enclosure after the gas has passed through said primary particle separator means. Particle storage means are provided to store particles collected by said secondary particle separator means. The particle storage means has a storage capacity determined by a range of variation of a circulating solids inventory in the reactor enclosure required for bed temperature control, considering expected variability of fuel and sorbent properties and load changes of said reactor. A recirculating system is provided for controllably recirculating the particles collected by said secondary particle separator means and stored in said particle storage means back into the lower portion of said reactor enclosure. A bed temperature control system is provided for controlling a recirculation rate of solids from said particle storage means into said reactor enclosure to change an inventory of circulating solids in the circulating fluidized bed reactor as required to control a temperature of the circulating fluidized bed in said reactor enclosure. Finally, a solids level control system, interacting with said bed temperature control system, is provided for controlling the inventory of solids in said particle storage means as required for bed temperature control.

Another aspect of the present invention is also drawn to a circulating fluidized bed reactor; in this embodiment, however, the particle storage means is at a remote location from said secondary particle separator means.

Yet another aspect of the present invention is drawn to a method for controlling a bed temperature of a circulating fluidized bed of solids material contained within and conveyed through a reactor enclosure of a circulating fluidized bed reactor, said reactor including primary and secondary particle separator means. The steps of this method comprise collecting particles entrained within a gas flowing through and from said reactor enclosure in said primary particle separator means and uncontrollably returning said particles to a lower portion of said reactor enclosure. The secondary particle collector is used to further collect particles entrained and still remaining within the gas flowing from said reactor enclosure, after the gas has passed through said primary particle separator means. These further collected particles collected by said secondary particle collector are stored in particle storage means and are controllably recirculated from a hopper connected to said particle storage means back into the lower portion of the reactor enclosure to change an inventory of circulating solids in the circulating fluidized bed reactor as required to control the bed temperature of the circulating fluidized bed in said reactor enclosure.

The various features of novelty which characterize the invention are pointed out with particularity in the claims annexed to and forming a part of this disclosure. For a better understanding of the invention, its operating advantages and the specific benefits attained by its uses, reference is made to the accompanying drawings and descriptive matter in which preferred embodiments of the invention are illustrated.

DESCRIPTION OF THE PREFERRED EMBODIMENTS

Figure 4:
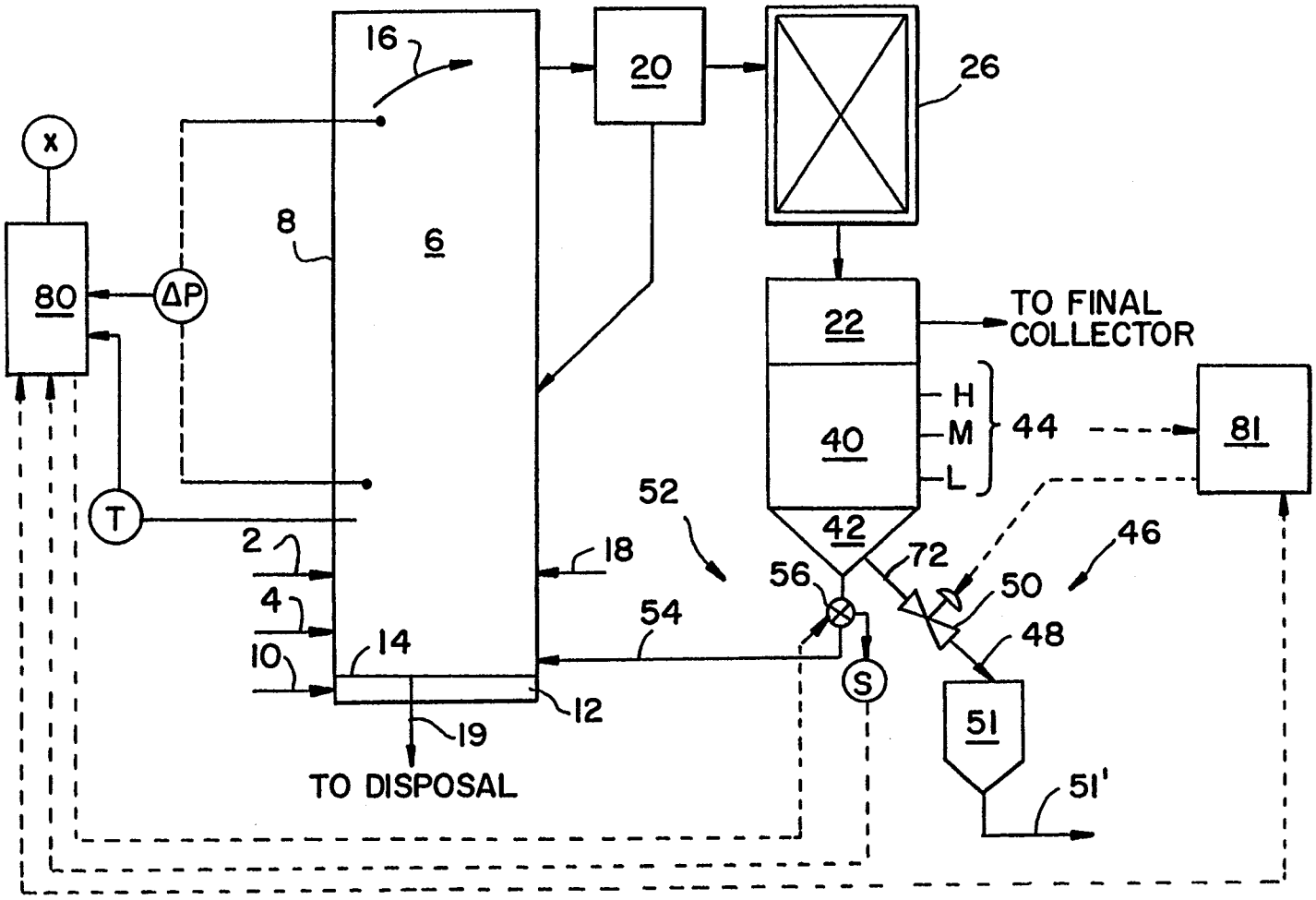
FIG. 4 is a schematic of a first embodiment of the present invention wherein means are provided for recirculating particles collected by a secondary particle separator and stored in a storage means located directly under the secondary separator back to the CFB reactor at a controlled rate to change the inventory of circulating solids in the CFB reactor as required to control CFB reactor bed temperature.

In the following discussion, like numerals represent the same or similar elements throughout the several drawings forming a part of this disclosure. A schematic of a first embodiment of the present invention is shown in FIG. 4. It is understood that while the primary particle separator 20 is schematically shown separately from reactor 6 in FIGS. 4 and 5 for clarity and discussion purposes, the embodiments of both FIGS. 4 and 5 encompass the aforementioned improved CFB reactor in U.S. patent application Ser. No. 08/037,986, filed Mar. 25, 1993, assigned to The Babcock & Wilcox Company, in which solids are collected by an entirely internal primary particle separator which also returns particles collected thereby internally and directly to a bottom portion of the CFB reactor, and the text of said application is herein incorporated by reference. Particles 16 are collected from the flue gas by a secondary particle separator 22 and recirculated back to the CFB reactor 6 at a controlled rate to change the inventory of circulating solids in the CFB reactor 6 and thus control CFB reactor bed temperature. A furnace bed temperature control system 80 controls the rate of recirculation of particles back to the CFB reactor 6. An arrangement of various sensing and/or transmitting elements for boiler load x, furnace differential pressure $\Delta P$, temperature T, and particle recirculation rates provides signals representative of the operating conditions of the CFB reactor to the bed temperature control system 80 so that it can determine and adjust a desired particle recirculation rate back to the reactor 6. Secondary particle storage means 40 is provided to store the particles 16; a solids storage level control system 81 controls the inventory or level of particles 16 within storage means 40. Storage means 40 may comprise a tank or other similar vessel and is typically located directly underneath secondary particle separator 22. A hopper 42 is provided at a lower portion of storage means 40. Storage means 40 has a capacity determined by the range of variation of a circulating solids inventory in the reactor enclosure 6 required for bed temperature control, considering expected variability of fuel and sorbent properties and load changes. Storage means 40 is equipped with level sensing means, generally referred to as 44, for sensing a level of solids therein. The storage level control system 81 controls the level based on a comparison of sensed solids level with a predetermined target level.

In a first embodiment, sensing means 44 may comprise one or more solids level sensing devices placed on storage means 40, such as capacitance probes, to sense the solids level at one or more discrete, predetermined locations. The simplest approach involves two locations on the storage means 40 corresponding to a "high" or maximum desired solids level and a "low" or minimum desired solids level therein. If desired, several probes could be used, each positioned on the storage means 40 at a solids level of interest. For example, and as shown in the Figures, three levels could be chosen, the first corresponding to a "medium" solids level M, the second corresponding to a "low" solids level L, and the third corresponding to a "high" solids level H. Particular control actions could then be devised, based upon a comparison of the sensed solids level with these three predefined levels.

In a second embodiment, sensing means 44 may comprise means for providing a continuous (non-discrete) sensed solids level at any location within the storage means 40. In such an embodiment, the designations of L, M, and H depicted in the Figures would more accurately represent setpoint levels that could be preset into the bed temperature control system 80, and the solids level control system 81 rather than actual physical locations of level sensing devices.

Purge means 46, advantageously comprising a purge line 72, a purge line 48 and solids flow control means 50, are provided and connected to hopper 42 to control a level of solids in particle storage means 40. Solids flow control means 50 typically comprises a remotely controllable gate valve or similar "on-off" type device under the control of the storage level control system 81. Purge line 48 discharges into a surge tank 51 from which the solids are evacuated for disposal by a solids evacuation system 51', advantageously a pneumatic system. The capacity of surge tank 51 is selected to provide a buffer capacity so that the capacity of the evacuation system 51' does not have to equal that of the purge means 46, which allows for cyclic operation of the solids evacuation system 51'.

A recirculating system 52 is controlled by the bed temperature control system 80 to obtain a desired recirculation rate of solids from the storage means 40 via hopper 42 back into a lower portion of the reactor enclosure or furnace 6 to change the inventory of circulating solids in the reactor as required to control CFB reactor bed temperature. System 52 advantageously comprises a recirculation line 54 for conveying solids from the hopper 42 back to the lower portion of the furnace 6. Means are provided for sensing (S in FIG. 4) and controlling a solids flow rate through recirculation line 54 and to provide a pressure seal between the higher pressure level existing at the point of solids introduction into the furnace 6 and the lower pressure level existing within hopper 42. These sensing and controlling means are operatively connected to bed temperature control system 80.

Figure 4A:
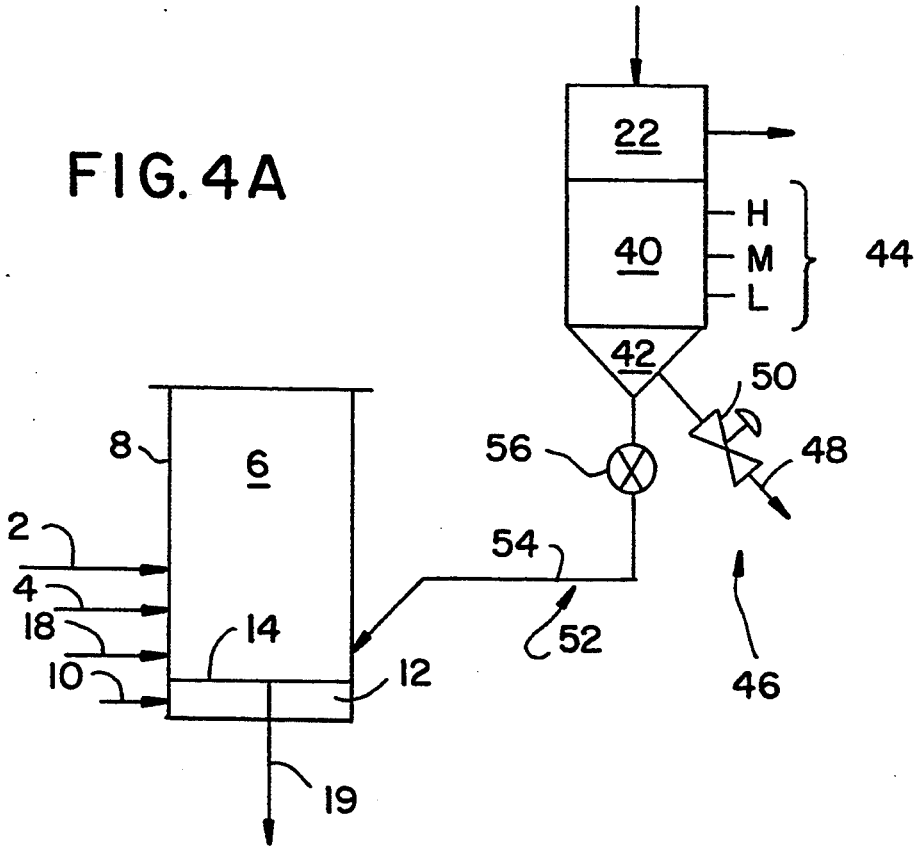
FIGS. 4*a*, 4*b*, and 4*c* are schematics of several embodiments of the particle recirculating means of FIG. 4.
Figure 4B:
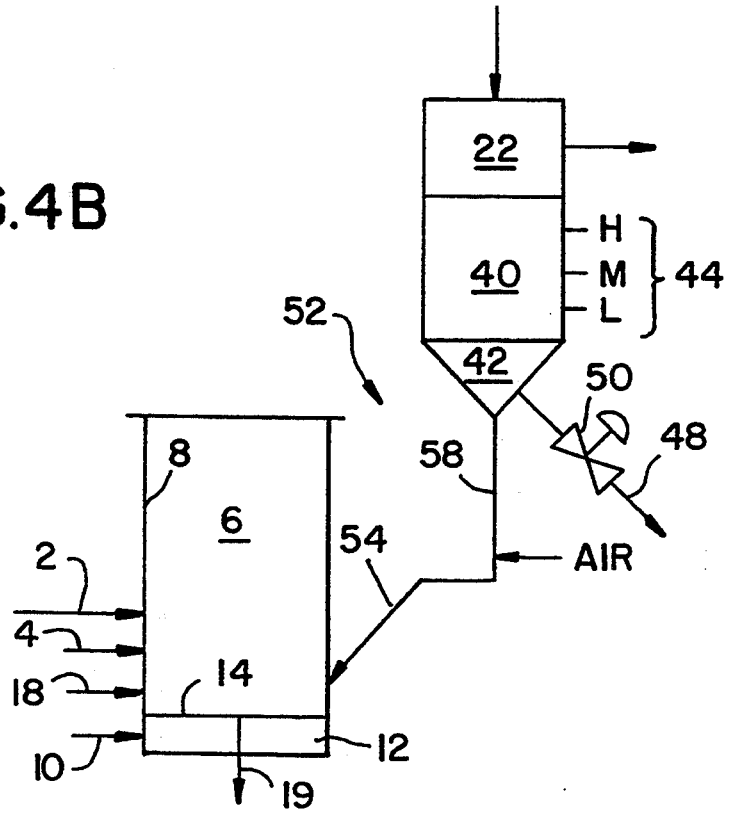
Figure 4C:
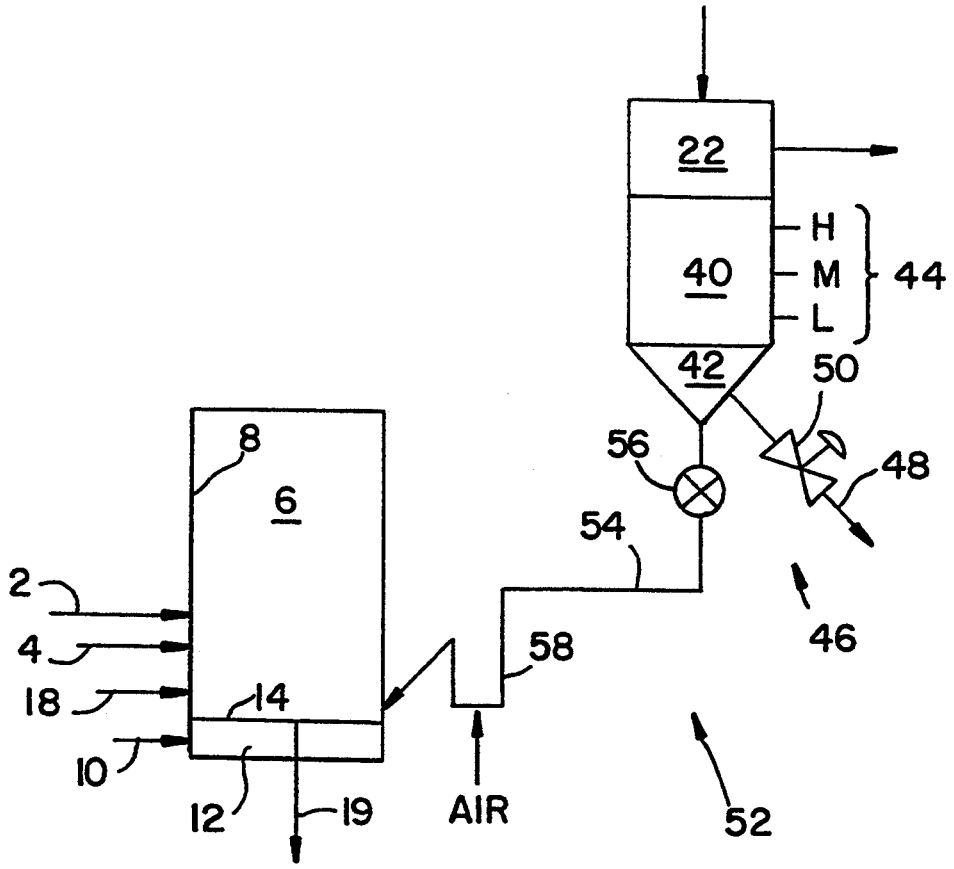

The present invention contemplates several embodiments for the recirculating system 52 to provide for solids flow rate control and pressure seal functions. Examples are shown schematically in FIGS. 4*a*, 4*b*, and 4*c*. As shown in FIG. 4*a*, one embodiment of system 52 uses mechanical means such as a rotary valve 56 to provide both a pressure seal and a means for controlling the rate of solids delivered therethrough. In this case the rotary valve speed S is used to sense the How rate of recirculated solids. As shown in FIG. 4*b*, a second embodiment uses non-mechanical means such as an L-valve system 58. Air supplied to the L-valve 58 provides the flow control of recirculated solids. In this case a flow rate of air supplied to the L-valve is used to sense the How rate of recirculated solids. Finally, FIG. 4*c* shows an arrangement wherein both mechanical and non-mechanical means (rotary valves for flow rate control and a J-valve or loop seal for pressure sealing) are used. Purge means 46, under the control of storage level control system 81, purges solids from hopper 42 to maintain a desired solids level in storage means 40. While FIGS. 4*a*–4*c* show three variations of system 52, it is understood that other arrangements can be employed.

As will be discussed more fully infra, control actions taken by the bed temperature control system 80 and the storage level control system 81 are coordinated depending upon a comparison of the sensed solids level in storage means 40 with predetermined solids level limits. For example, when the sensed level is at or below "low", the recirculation rate of particles back to the CFB reactor can not be increased, and actually will be reduced until the solids level in storage means 40 is above the "low" level.

Figure 5:
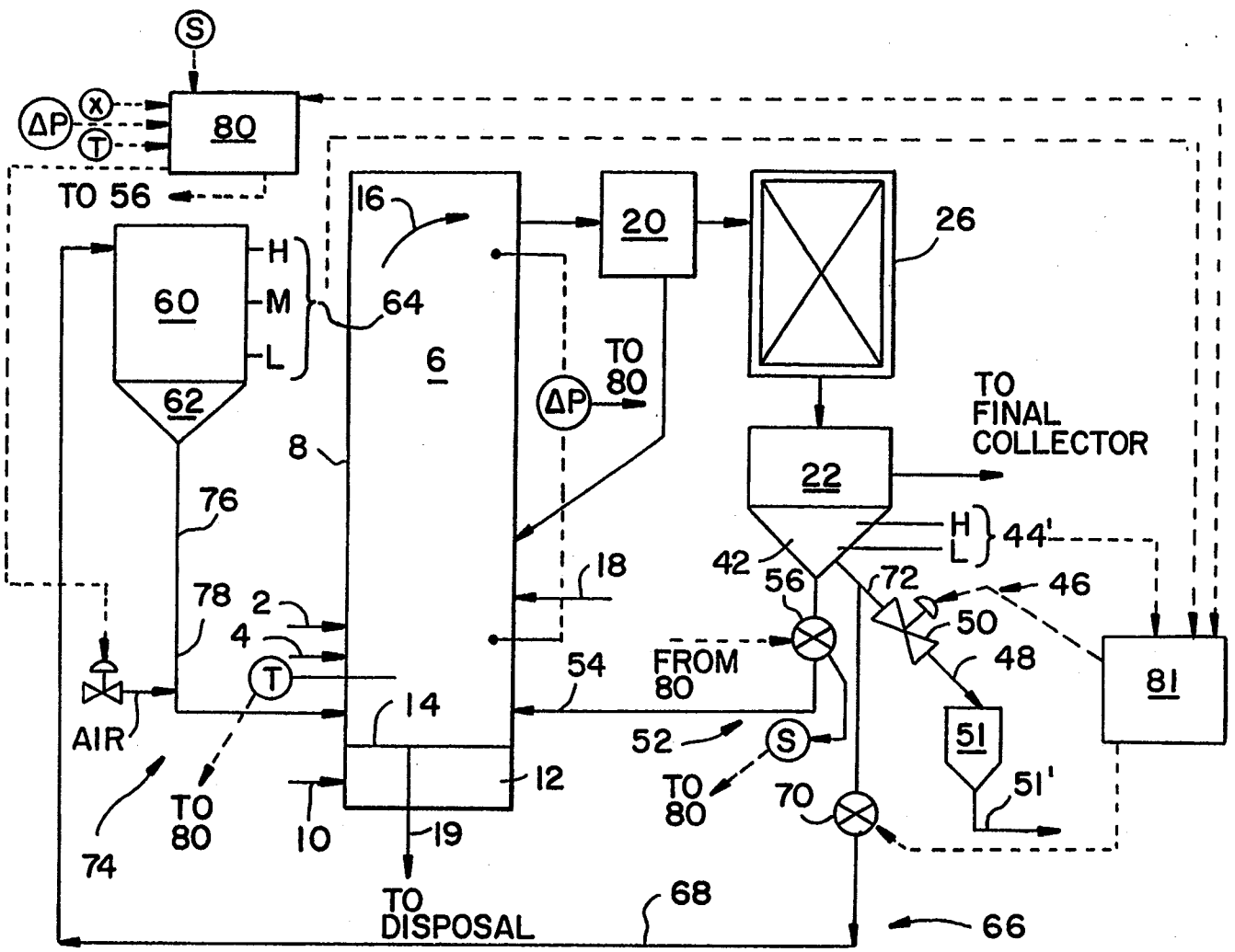
FIG. 5 is a schematic of a second embodiment of the present invention wherein said particle storage means is provided at a remote location from said secondary particle separator means.

A second embodiment of the present invention is shown in FIG. 5. In this arrangement, a particle storage means 60 is provided to store particles 16 removed from the flue gas by the secondary particle separator 22, but storage means 60 is located at a remote location from secondary particle separator 22. Storage means 60 may comprise a tank or similar vessel provided with a hopper 62 at a lower portion thereof, and the storage capacity of storage means 60 is selected using the same criteria described earlier for storage means 40. Level sensing means, generally referred to as 64, would be provided for sensing a level of solids within the storage means 60, and could take the form of the various embodiments mentioned earlier in connection with storage means 40.

In FIG. 5, hopper 42 is now connected directly to the secondary particle separator 22 at a lower portion thereof. The recirculating system 52 again controllably recirculates particles collected by the secondary particle separator 22 from hopper 42 back into the lower portion of the furnace 6. The flow rate through recirculating line 54 is provided to bed temperature control system 80 via rotary valve speed sensor S. Again, various other sensing and/or transmitting elements for boiler load x, furnace differential pressure $\Delta P$, temperature T, and speed (RPM) S provide information on the operational parameters of the CFB reactor to the bed temperature control system 80. System 52 is primarily retained because it is undesirable from a cost and power standpoint to circulate all the solids collected and recirculated by the secondary particle separator 22 through a solids transport system 66 (discussed infra) to storage means 60.

In the embodiment of FIG. 5, solids level sensing means 44' are provided on hopper 42 for sensing "high" and "low" levels of particles therein. Purge means 46, again under the control of storage level control system 81, interacting with bed temperature control system 80, purges solids from hopper 42 to maintain a desired solids level in hopper 42.

The capacity of the hopper 42 inbetween these "high" and "low" limits is determined by the minimum value required for proper functioning of the solids purge system 46 without excessively frequent cycling. This sizing criteria is similar to that used for hoppers 32 of the prior art.

A solids transport system 66, advantageously a pneumatic conveyor, is provided and comprises a transport line 68 and solids flow control means such as a rotary valve 70. As shown in FIG. 5, solids transport system 66 receives collected particles from hopper 42 and transports them to storage means 60. Transport line 68 may be connected to purge line 72 at a point between hopper 42 and valve 50, as shown in FIG. 5, or it may be connected directly to hopper 42.

An injection system 74 connects hopper 62 with the furnace 6 via injection line 76. In this embodiment, injection system 74 is under the control of bed temperature control system 80, and has the primary responsibility for solids inventory transfer into the furnace 6 (from the storage means 60) to obtain a desired furnace inventory and, consequently, bed temperature. Solids flow control means such as an L-valve 78 or rotary valve are provided in injection line 76. Again, the solids flow control means could be mechanical, non-mechanical or a combination of both.

The remotely located particle storage means 60 of FIG. 5 can be used to advantage when the arrangement of a CFB system does not provide enough room to install storage means 40 of required capacity under the secondary particle separator 22. The remote location also permits a height difference to be provided between the bottom of the storage means 60 and the bottom of the furnace 6. Such a height difference is needed for gravity-assisted solids transfer such as by the use of an L-valve, J-valve, air slide, gravity chute, etc., which are desirable for better reliability and simplicity.

PRINCIPLES OF OPERATION OF THE INVENTION

A known CFB reactor bed temperature control system changes the furnace inventory to adjust the furnace heat absorption so that the measured bed temperature would match the target bed temperature which is determined depending on reactor load (or boiler steam flow). Reactor inventory is measured as the pressure drop or differential between specified elevations within the reactor enclosure 6, as is known to those skilled in the art.

The present invention builds upon such known control strategy by providing the furnace bed temperature control system 80 which modifies the rate of solids introduction into the reactor enclosure 6 from the secondary particle storage means 40 or 60 to obtain a desired reactor inventory, and consequently, a desired bed temperature. The solids storage level control system 81 selects and maintains by means of solids purge or transfer a target inventory for the storage means 40 or 60 as a function of reactor load and furnace inventory, limited between predefined "high" and "low" levels, or alternatively sets the inventory target for the storage means 40 or 60 at the "high" limit.

The method of this invention is more effective when used in CFB systems with a comparatively less efficient variety of primary particle separators 20, for example, impact-type particle separators, and where the secondary particle separators are followed by a final or tertiary solids collection device (e.g. baghouse or electrostatic precipitator). The secondary particle separators 22 in this case are typically a mechanical separator (e.g. multicyclone or cyclone dust collector) which are not very efficient in collecting the finest size particles. This is an advantage, however, from an inventory control viewpoint since it helps avoid undesirable dilution of the recirculated material with particles not retained in the reactor.

During steady state operation with an uncontrolled solids return from the primary particle separator 20, the total solids inventory in the CFB furnace 6 and its distribution between dense (lower bed) and dilute (upper bed) parts of the furnace 6 is determined by the fuel 2 and sorbent 4 properties and input flows, primary particle separator 20 and secondary particle separator 22 collection efficiencies, gas velocity in the CFB reactor, the air split between air 10 supplied to the windbox 12 and overfire air 18, the flow rate of solids leaving through the bed drain purge 19, and the solids recycle rate from the secondary particle separator 22. In steady-state conditions, the recirculation rate is set by the reactor performance requirements, and the purge rate of solids collected by the secondary particle separator 22 maintains the solids balance in the system.

The bed temperature control system 80 develops a demand to increase the furnace inventory when the measured furnace temperature is above the target value, or to decrease the furnace inventory when the measured furnace temperature is below the target value. The furnace temperature target commonly is a function of the CFB reactor or boiler load (or boiler steam flow), with provision for adjustment (bias) by a human operator. For a more dynamic control response, the dilute bed inventory is also being measured as a pressure differential between two points in the upper portion of the reactor or furnace enclosure 6 and is compared with the pre-established furnace inventory target which is a function of the CFB reactor load. The furnace bed temperature control system 80 compares the measured furnace temperature and pressure differentials with their corresponding target levels and develops a demand signal, using known signal processing means, corresponding to a desired flow of solids recirculated from the storage means 40 or 60 to the furnace 6. This demand signal is compared with the actual solids recirculation rate (measured as rotary valve RPM or L-valve control air flow) and changes the recirculation rate to meet the demand.

For the system shown in FIG. 4, the furnace bed temperature control system 80 interacts with the particular flow control means 56 and/or 58 (see FIGS. 4*a*–4*c*) provided in the recirculating system 52.

For the system shown in FIG. 5, the furnace bed temperature control system 80 interacts with the particular flow control means provided in both the injection system 74 and recirculating system 52. When the demand signal from the furnace bed temperature control system 80 is to increase furnace inventory, a control signal is sent to injection system 74 and recirculating system 52. A feedback adjustment of the recirculation rate in system 52 is provided through interaction between the solids storage level control system 81 and bed temperature control system 80. When there is a signal to increase the furnace inventory, this adjustment will increase the recycle flow through recirculating system 52 when the hopper 42 level is "high" or decrease the recycle flow when the hopper 42 level is "low." Similarly, when there is a signal to decrease the furnace inventory, a signal is sent to injection system 74 to halt the solids injection, and to recirculating system 52 to decrease the recirculating flow with a corresponding feedback adjustment based on the level position in the hopper 42.

Limits are imposed on the control action for adjusting the recirculation rate as follows:

In the embodiments of FIGS. 4 and 5, the recirculation rate through recirculating system 52 cannot be increased beyond a pre-established maximum flow limit.

The recirculation rate through recirculating system 52 cannot be increased when the level in the storage means 40 (FIG. 4) or hopper 42 (FIG. 5) is at or below the "low" limit, since there would not be any substantial quantity of particles to recirculate, while maintaining the pressure seal.

The recirculation rate through recirculating system 52 cannot be increased when the total furnace inventory differential is at or above a predetermined maximum limit. (This is primarily a system limitation imposed by the capacity of the fan providing air to the CFB reactor.)

The solids storage level control system 81 controls the solids level in the storage means 40 (of FIG. 4), and in the storage means 60 and hopper 42 (of FIG. 5).

In the embodiment of FIG. 4, solids storage level control system 81:

(a) opens the purge valve 50 when the solids level in storage means 40 is at or above the target level (which may be up to and including the "high" level), and there is no demand from the bed temperature control system 80 to increase the solids recirculation rate through recirculating system 52; and (b) keeps the purge valve 50 closed when the solids level in storage means 40 is below the target level.

In the embodiment of FIG. 5, solids storage level control system 81:

(a) opens the purge valve 50 when the solids level in storage means 60 is at or above the target level (which may be up to and including the "high" level), and there is no demand from the bed temperature control system 80 to inject solids to the reactor 6 from storage means 60, and the solids level in hopper 42 is at or above the "high" limit;

(b) increases solids flow through the transport line 68 when the solids level in storage means 60 is below the target level, and the solids level in hopper 42 is above the "low" limit; and (c) keeps the purge valve 50 closed when the solids level in storage means 60 is below the target value.

For the embodiment of FIG. 4, the system according to this invention is operated and controlled as follows:

The recirculation rate from the storage means 40 changes depending upon the demand established by the bed temperature control system 80. The purge rate is controlled to maintain the target inventory level in the storage means 40.

For example, when the bed temperature increases due to changes in fuel or sorbent properties, the heat absorption by the reactor heating surfaces may need to be increased to control the bed temperature. This is done by increasing the solids inventory (density) in the dilute (upper) part of the bed where most of the heating surface is located. This can be accomplished by reducing the solids flow rate leaving the bed drain purge 19, but this type of control action is slow due to the low bed drain purge 19 capacity as compared to the flow of solids recirculated from the primary particle separator 20 or secondary particle separator 22. It is also inefficient since the dense (lower) bed inventory tends to increase more rapidly than the dilute (upper) bed inventory. The total reactor inventory increase also results in a higher forced draft fan pressure and consequently higher power consumption.

The present invention provides a better way to increase the dilute bed inventory, and that is by increasing the recirculation rate of solids collected by the secondary particle separator 22, stored in storage means 40, into the reactor. This control action is comparatively quick, due to the higher recirculation flow rate available, as compared to the bed drain purge rate 19, and is also much more effective since a change of the recirculation rate from storage means 40 affects mostly the dilute (upper) bed inventory with a relatively small change in the dense (lower) bed inventory. These different effects occur because the solids contained in storage means 40 are those which passed through the primary particle separator 20 and are much finer in size than those collected by the primary particle separator 20.

Particles 16 in the flue gas are in a size range of approximately below 5 to 800 microns (1 micron $=1\times10^{-6}$ meters). The primary particle separator 20 is efficient for particles larger than 75 microns and collects almost all particles larger than 250 microns. The secondary particle separator 22 typically can collect particles 16 from the flue gas larger than 5–10 microns and almost all particles larger than 75 microns are collected.

The extent of dilute (upper) bed inventory control by changing the recirculation rate from the secondary particle separator 22 is determined by the amount and size distribution of particles stored in storage means 40. The most important particles for dilute (upper) bed inventory control are particles in a size fraction effectively collected by the primary particle separator 20 (typically, those larger than 75 microns for CFB reactors with impact-type primary particle separators). Any incremental increase of the recirculation rate of particles 16 in this 75 to 250 micron range collected by the secondary particle separator 22 and stored in storage means 40 results in a 15–25 times greater incremental increase in the primary particle separator 20 recirculation rate (assuming a 93–95% fractional collection efficiency of the primary particle separator 20 for particles in this size range), and a corresponding increase of inventory of these particles 16 in the reactor. Smaller particles, which the primary particle separator 20 does not remove, will not remain in the reactor 6 and will pass on through to the secondary particle separator 22.

On the other hand, addition of particles in a 250–800 micron range would be less efficient for increasing the dilute bed inventory, as compared to particles in the 75–250 micron range, since a larger portion of these particles will accumulate in the dense (lower) bed inventory. If high furnace 6 temperatures are sensed, an inventory control function in the bed temperature control system 80 generates a signal to increase the inventory of the dilute (upper) bed, and the recirculation flow from storage means 40 through the system 52 will be increased. This will result in an inventory decrease in storage means 40 and an inventory increase in the CFB reactor furnace 6. When, as a result of this action, the level in storage means 40 falls below the target level, solids flow from hopper 42 via purge means 46 ceases. After an initial transient period, the solids inventory in the furnace 6 and in the storage means 40, as well as the solids recirculation rate through system 52, will stabilize at some new values with a higher furnace 6 inventory, a lower solids inventory in storage means 40, and a higher recirculation rate in the recirculating system 52.

Continued input of solids (fuel, sorbent, etc.) to the CFB in the absence of solids purge from the hopper 42 will cause the inventory in storage means 40 to gradually increase. No solids are purged from the storage means 40 via purge means 46 until the solids level therein reaches the target level. At this point, purge means 46 resumes operation, and the size and rate of particles being purged will correspond to the new solids system equilibrium.

Similar actions, but in the opposite direction, would be taken if the CFB furnace 6 bed temperature drops, which requires that the CFB furnace 6 inventory be reduced to decrease heat absorption by the CFB reactor heating surface. The recirculation rate from the storage means 40 will be reduced in response to a demand signal from the bed temperature control system to transfer inventory from the CFB reactor to storage means 40. The overall CFB system response to the control action in this case is similar to that previously described: an initial strong response will be followed by a stabilization period during which a new equilibrium is established, having a lower dilute (upper) bed inventory, and a lower recirculation rate in the recirculating system 52. Solids transferred from the furnace to storage means 40 will be purged via purge means 46, if the solids level in the storage means exceeds the target value.

When the CFB boiler load changes, appropriate correction of the furnace inventory will be done in a similar way, with the bed temperature in the reactor being a primary controlled variable. On a load reduction, the recirculation rate from the storage means 40 is reduced as required to maintain the bed temperature at a target level, and the inventory in the dilute (upper) bed is reduced by transferring the circulating solids to the storage means 40. The purge means 46 will resume operation when the level in storage means 40 is above the target level, disposing of solids to the buffer storage 51. On a load increase, stored solids are transferred from the storage means 40 to the furnace 6 to control the bed temperature, as described above. As soon as the solids level in the storage means 40 falls below the target level, the purge means 46 is deactivated.

For the embodiment of FIG. 5, the system according to this invention is operated and controlled as follows:

The recirculation rate of solids collected by the secondary particle separator 22 and supplied to the furnace by injection system 76 and recirculation system 52 changes depending upon the inventory demand established by furnace bed temperature control system 80. The purge rate and solids transfer rate to the storage means 60 are controlled by the solids storage level control system 81 to maintain the target level of solids in the storage means 60 and hopper 42.

Recirculating system 52 operates continuously when the CFB reactor or combustor is operating. When the furnace inventory is increased by the bed temperature control system 80 by transferring solids from the storage means 60, the recirculation rate in system 52 also increases, due in part to a feed forward signal to system 52 and due to a feedback signal when the level in hopper 42 is at or above a target level. When the furnace inventory is decreased by the bed temperature control system 80, a signal is sent by system 80 to system 52 to decrease the recirculation rate.

Solids transport system 66 operates intermittently during CFB reactor or combustor operation; i.e., only when the solids level in storage means 60 is below a target level. When the level in storage means 60 falls below the target level, solids transport system 66 is directed by the solids level storage control system 81 to add material and bring the level up to the target level. Feedback is provided by level sensing means 64 provided on the particle storage means 60.

Injection system 76 operates only when it is desired to increase furnace inventory. Injection halts when the level in storage means 60 is at or below the "low" level; feedback is provided by level sensing means 64.

Purge system 46 operates when the level in hopper 42 is at or above an upper target level and (a) there is no demand for solids transport system 66 to increase the inventory in storage means 60, (b) there is no demand to increase recirculation through system 52, and (c) when the level in hopper 42 reaches an extreme "high" level, or the level in hopper 42 remains at or above the upper target level for longer than a preset time limit. In other words, if there is a demand for solids in other portions of the CFB reactor or in the storage means 40 or 60, purge means 46 will be deactivated unless overridden by other considerations.

Control actions taken by the bed temperature control system 80 and solids storage level control system 81 are affected by the sensed level of particles in hopper 42 in the following manner:

When the sensed level in hopper 42 is "high":

The furnace bed temperature control system 80 will increase the recirculation rate of particles via recirculating system 52 back to the CFB reactor if it is necessary to increase furnace bed inventory, and the recycle rate is below its maximum limit.

If there is no demand from the furnace bed temperature control system 80 to increase furnace bed inventory, and the level in storage means 60 is below its target value the solids storage level control system 81 will transfer particles from the hopper 42 to the storage means 60.

If there is no demand from the furnace bed temperature control system 80 to increase furnace bed inventory, and the level in storage means 60 is at or above its target value, the solids storage level control system 81 will purge solids from the hopper 42.

When the sensed level in hopper 42 is "low":

A limit signal is sent by the solids storage level control system 81 to the furnace bed temperature control system 80 to decrease the recycle rate; i.e., to override the furnace bed temperature control system 80.

The control strategies described above are in some cases one of several possible options. Alternative strategies can be suggested by those skilled in the art within the scope of the inventory control method per this invention. The system and method of the present invention is applicable for the following conditions:

1. During Constant Load Operation
   a) when the solids recirculation rate, determined by the CFB reactor performance requirements, is substantially lower than the maximum rate, based on the recirculation system capacity or maximum allowable solids loading in the convection surfaces, and
   b) when a purge from the secondary particle separator is needed for the system material balance.
2. During Load Changes
   for any CFB system as described above.

ADVANTAGES OF THE INVENTION

Figure 1:
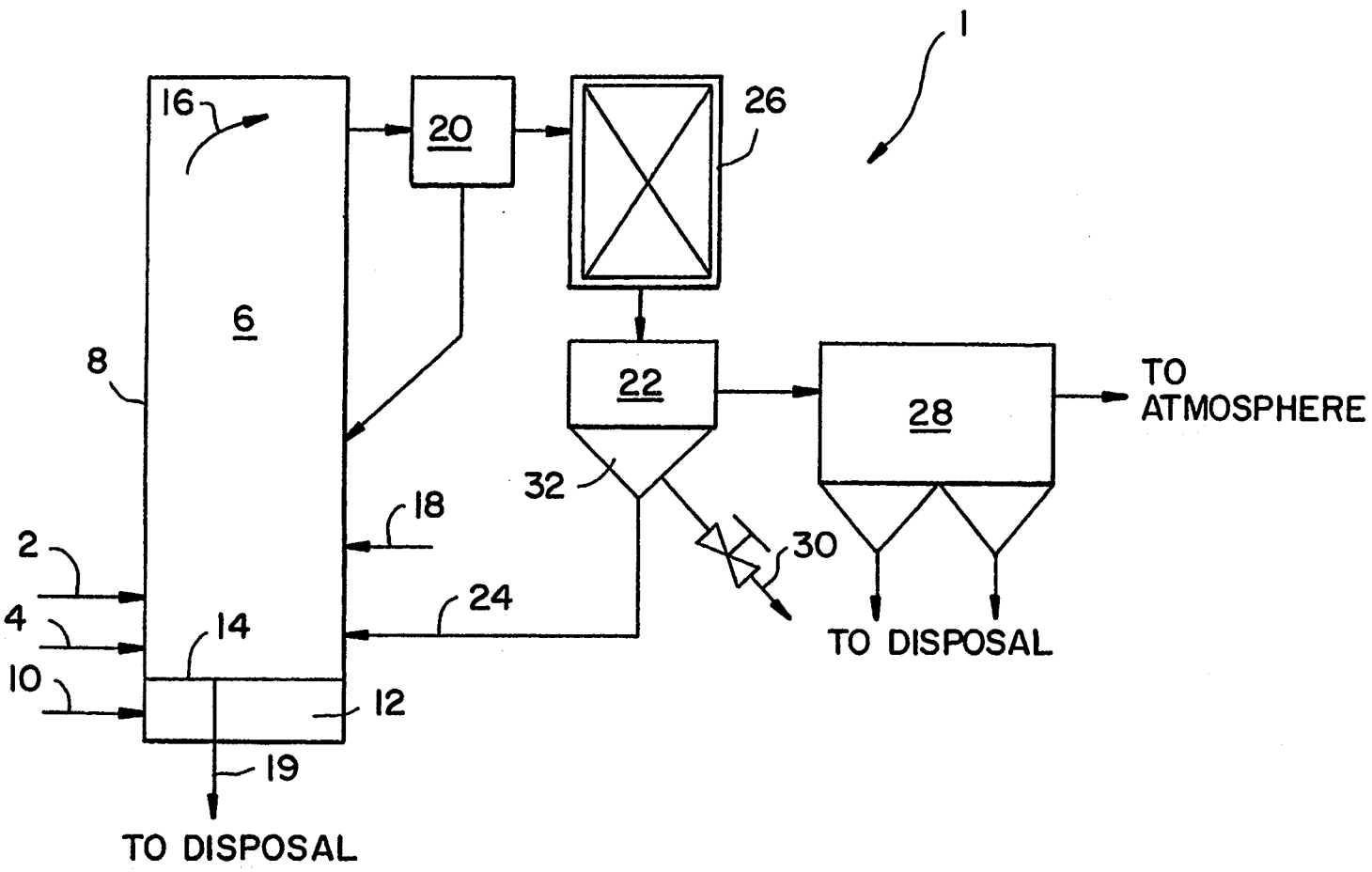
FIG. 1 PRIOR ART
FIG. 1 is a schematic of a known circulating fluidized bed (CFB) system having external primary, secondary, and tertiary particle separators, and recirculation of collected particles from the primary and secondary particle separators back to the CFB.
Figure 2:
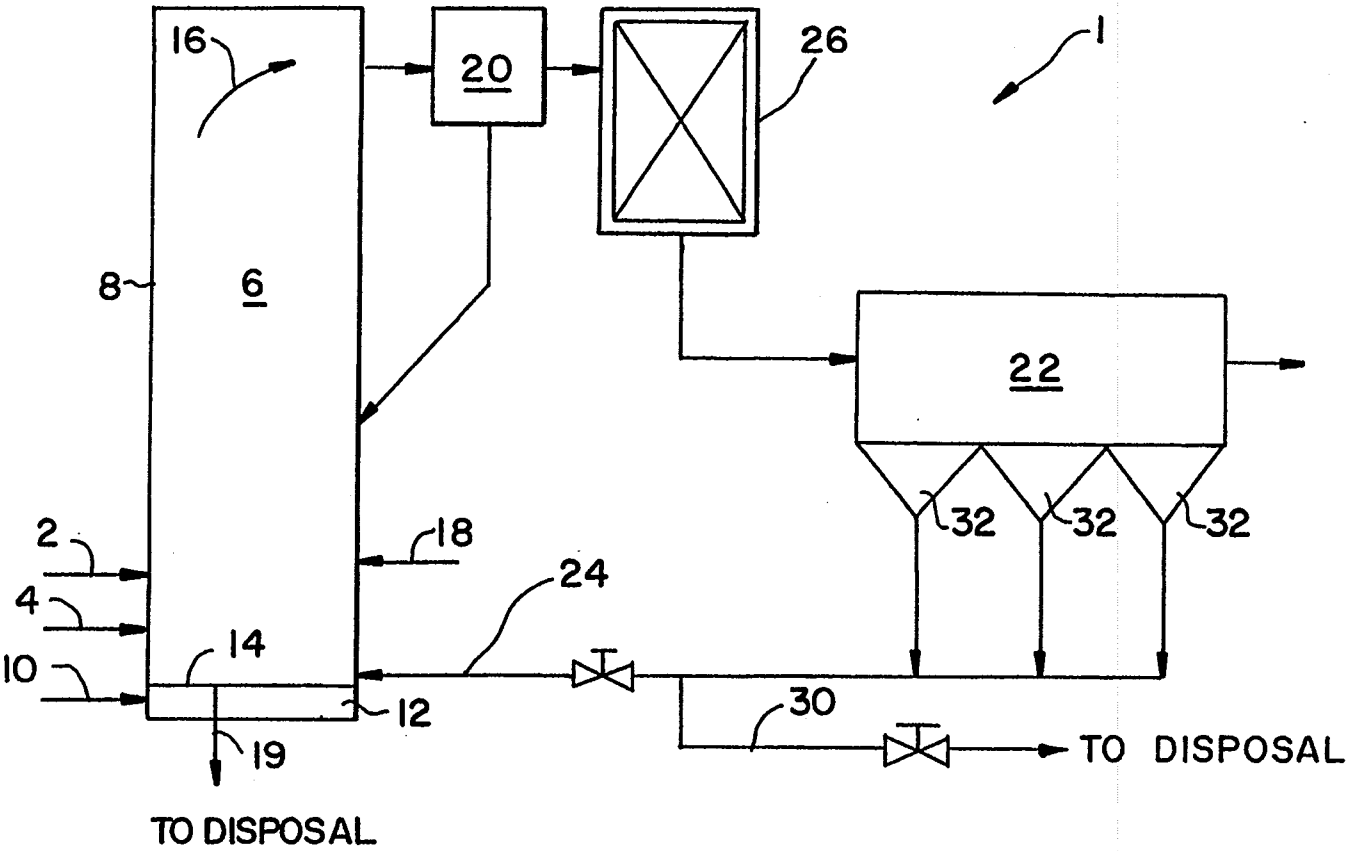
FIG. 2 PRIOR ART
FIG. 2 is a schematic of a known CFB system having external primary and secondary particle separators, and recirculation of collected particles from the primary and secondary particle separators back to the CFB.

The advantage of this invention, as compared with the prior art shown in FIGS. 1 and 2, is that it makes possible an inventory transfer between the reactor and a solids storage means connected to the secondary particle separator 22 for controlling the heat absorption in the reactor and, therefore, the reactor bed temperature, in response to variations in fuel or sorbent properties or load changes.

During constant load operation, the inventory buffer in the storage means 40 or 60 improves the dynamic response of the CFB reactor to a demand generated by the bed temperature control system, making possible a quick change in the recirculation flow from the storage means 40 or 60.

In known CFB applications, the rate of increase of the recirculation flow from the hopper 32 is determined by the rate of increase of the inventory of circulating material in the CFB system in response to reduction of the hopper 32 purge. The rate of the recirculation flow increase in this case is slow and, where only a small amount of solids is contained in the hopper 32, the amount is insufficient for responsive reactor inventory control.

During load changes, accumulation of solids in the storage means 40 or 60 (on load decrease) or transfer of solids from the storage means 40 or 60 to the CFB reactor (on a load increase), provides for an extended turndown ratio and greater rate of load change capability. This reduces consumption of the bed material (make-up) previously required for reactor inventory control during the load changes.

Figure 3:
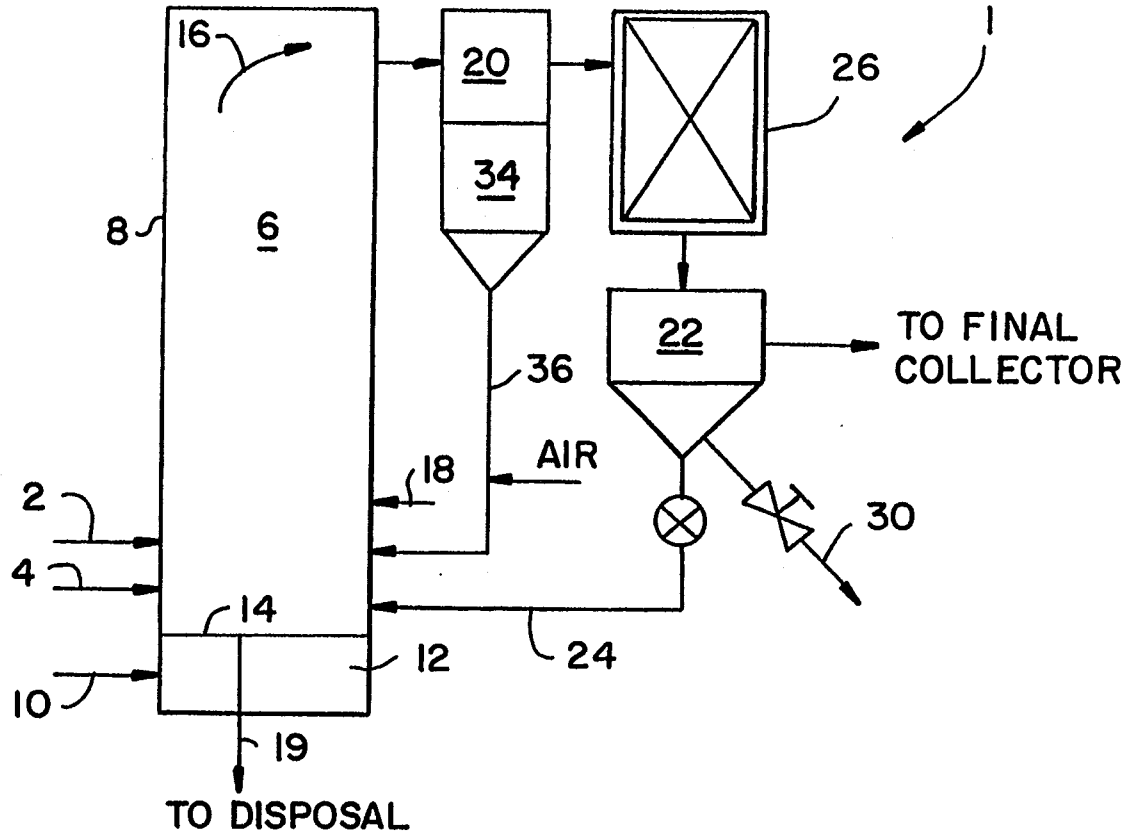
FIG. 3 PRIOR ART
FIG. 3 is a schematic of a known CFB system having external primary and secondary particle separators, controlled recirculation of collected particles from a primary particle storage back to the CFB to control a bed temperature of the CFB reactor, and recirculation of particles collected by the secondary particle separator back to the CFB.

The advantages of this invention over the prior art shown in FIG. 3 are several:

1. The stored solids in a CFB system per this invention have a considerably lower temperature (typically 500° F. versus 1600° F. in prior art during high load operation) which avoids agglomeration in stagnant conditions. Solids agglomeration in the primary particle storage hopper 34 and L-valve 36 can be an obstacle to using particles collected by the primary particle separator for reactor inventory control during high load operation of such a CFB unit.
2. Per this invention, the stored circulating solids have a considerably smaller mean size which enhances the effect of the reactor inventory change on the furnace heat transfer (since the heat transfer rate is greater for smaller diameter particles).
3. The transfer of finer particles affects predominantly the dilute (upper) bed inventory which is responsible for most of the solids to wall heat transfer in a CFB reactor. In the prior art, where the size of the particles collected by the primary separator stored solids is greater, the inventory transfer significantly affects the dense bed inventory which produces a small effect on the heat transfer. As a result, the overall increase of total reactor inventory corresponding to the required increase of dilute (upper) bed inventory is greater, which causes higher required fan pressure and greater fan power consumption.

4. During constant load operation, solids transfer in the known CFB applications has only a transient effect, since it does not change the steady state material balance of the CFB system; i.e., in the amount and distribution of purge flow of circulating solids between the bed drain purge 19 and purge system 30 connected to the secondary particle separator. During steady state conditions, this distribution determines the inventory of circulating solids in the reactor. When the dilute (upper) bed inventory in the CFB reactor is increased by transferring solids from the primary particle separator storage 34 (and increasing primary particle separator 20 recirculation rate), this will also result in an increased concentration of circulating solids in the dense (lower) bed. This causes a higher loss of circulating material through the bed drain purge 19. The purge rate from the secondary particle separator 22 also increases in a system with a limited secondary particle separator recirculation rate due to a higher amount of circulating material passing through the primary particle separator 20. With higher losses and the input of solids to the system unchanged, the inventory of circulating material in the reactor will gradually decrease to the original steady state value corresponding to the original system material balance. In contrast, the present invention achieves a permanent (steady state) inventory increase due to reduced losses via the purge means 46 when the recirculation rate from the storage means 40 or 60 is increased. The reduced purge rate will be compensated for by an increase of the purge rate through the bed drain purge 19, corresponding to the reactor inventory increase.

While specific embodiments of the invention have been shown and described in detail to illustrate the application of the principles of the invention, those skilled in the art will appreciate that changes may be made in the form of the invention covered by the following claims without departing from such principles. For example, while the furnace bed temperature control system and the solids storage level control system have been shown and described for clarity purposes as two separate systems, persons skilled in the control arts will readily appreciate that these "systems" could be incorporated as interrelated control functions implemented in a programmable, microprocessor-based digital control system. This flexibility thus readily lends itself to applications of the present invention to new construction involving circulating fluidized bed reactors or combustors, or to the replacement, repair or modification of existing circulating fluidized bed reactors or combustors. In some embodiments of the invention, certain features of the invention may sometimes be used to advantage without a corresponding use of the other features; likewise, some features may be combined to achieve a desired result. Accordingly, all such changes and embodiments properly fall within the scope of the following claims.

We claim:

1. A circulating fluidized bed reactor, comprising:

a reactor enclosure for containing and conveying a circulating fluidized bed of material, said enclosure having a lower portion and an upper portion;

primary particle separator means for collecting particles entrained within a gas flowing through and from said reactor enclosure;

means for returning the particles collected by said primary particle separator means back to the lower portion of said reactor enclosure;

secondary particle separator means for further collecting particles entrained and still remaining within the gas flowing from said reactor enclosure after the gas has passed through said primary particle separator means;

particle storage means, having a storage capacity determined by a range of variation of a circulating solids inventory in said reactor enclosure required for bed temperature control, considering expected variability of fuel and sorbent properties and load changes of said reactor, for storing particles collected by said secondary particle separator means;

a recirculating system for controllably recirculating the particles collected by said secondary particle separator means and stored in said particle storage means back into the lower portion of said reactor enclosure;

a bed temperature control system for controlling recirculation rate of solids from said particle storage means into said reactor enclosure to change an inventory of circulating solids in the circulating fluidized bed reactor as required to control a temperature of the circulating fluidized bed in said reactor enclosure; and a solids storage level control system, interacting with said bed temperature control system, for controlling the inventory of solids in said particle storage means as required for bed temperature control.

2. The reactor of claim 1, wherein said particle storage means is equipped with means for sensing a level of solids therein.

3. The reactor of claim 2, wherein said particle storage means is located directly underneath said secondary particle separator means, and further comprising purge means, under the control of said solids storage level control system, for controlling a level of solids in said particle storage means based upon said sensed solids level.

4. The reactor of claim 1, wherein said recirculating system comprises a recirculation line for conveying solids from said particle storage means to the lower portion of said reactor enclosure, and means under the control of said bed temperature control system for controlling a solids flow rate through said recirculation line.

5. The reactor of claim 1, wherein said particle storage means is at a remote location from said secondary particle separator means, and further comprising:

a solids transport system, under the control of said solids storage level control system, for conveying particles from said secondary particle separator means to said particle storage means; and an injection system, under the control of said bed temperature control system, for controllably injecting the particles stored in said remotely located particle storage means back into the lower portion of said reactor enclosure to change an inventory of circulating solids in the reactor as required to control a temperature of the circulating fluidized bed in said reactor enclosure.

6. The reactor of claim 5, wherein said remotely located particle storage means is equipped with means for sensing a level of solids therein.

7. The reactor of claim 5, wherein said solids transport system comprises a line for conveying solids from said secondary particle separator means to said remotely located particle storage means, and means for controlling a solids flow rate through said line.

8. The reactor of claim 5, wherein said injection system comprises a line for conveying solids from said remotely located particle storage means to the lower portion of said reactor enclosure, and means for controlling a solids flow rate through said line.

9. The reactor of claim 6, further comprising a hopper located at a lower portion of said secondary particle separator means, means for sensing a level of solids in said hopper, and purge means, under the control of said solids storage level control system, for controlling a level of solids in said hopper based upon said sensed level of solids in said hopper.

10. The reactor of claim 1, further comprising means for providing signals representative of operating conditions of the reactor to said bed temperature control system to enable said bed temperature control system to determine a desired particle recirculation rate back to the reactor.

11. A method for controlling a bed temperature of a circulating fluidized bed of solids material contained within and conveyed through a reactor enclosure of a circulating fluidized bed reactor, said reactor including primary and secondary particle separator means; comprising the steps of:

collecting particles entrained within a gas flowing through and from said reactor enclosure in said primary particle separator means and returning said particles to a lower portion of said reactor enclosure;

using the secondary particle separator to further collect particles entrained and still remaining within the gas flowing from said reactor enclosure after the gas has passed through said primary particle separator means;

storing said further collected particles collected by said secondary particle separator in particle storage means; and controlling a recirculation rate of solids from said particle storage means into the lower portion of the reactor enclosure to change an inventory of circulating solids in the circulating fluidized bed reactor by changing an inventory of material in said storage means as required to control a temperature of the circulating fluidized bed in said reactor enclosure.

12. The method of claim 11, further comprising the steps of sensing whether there is a demand to increase or decrease the recirculation rate of solids from said particle storage means to the lower portion of the reactor enclosure, and not purging solids from said particle storage means when there is a demand to increase the recirculation rate of solids from said particle storage means into the lower portion of the reactor enclosure.

13. The method of claim 11, further comprising the steps of sensing whether there is a demand to increase or decrease the recirculation rate of solids from said particle storage means to the lower portion of the reactor enclosure, and purging solids from said particle storage means when there is a demand to decrease the recirculation rate of solids from said particle storage means into the lower portion of the reactor enclosure.

14. The method of claim 11, further comprising the step of sensing a solids level within said particle storage means.

15. The method of claim 14, further comprising the steps of establishing a target solids level for said particle storage means, comparing said target solids level with said sensed solids level, and controlling the solids level within said particle storage means based upon said comparison by regulating a purge flow of solids from said particle storage means.

16. The method of claim 15, further comprising the step of purging solids from said particle storage means if said sensed solids level is above said target solids level and if there is no demand to increase the recirculation rate of solids from said particle storage means into said reactor.

17. The method of claim 15, further comprising the steps of not purging solids from said particle storage means when said sensed solids level is below said target level.

18. The method of claim 11, further comprising the steps of recirculating a first portion of said further collected particles directly back to a lower portion of said reactor enclosure through a recirculating system and transporting a second portion of said further collected particles through a solids transport system to said particle storage means.

19. The method of claim 18, further comprising the step of controlling the recirculation rate of solids from said particle storage means into the lower portion of the reactor enclosure by controlling an injection rate of particles from said particle storage means through an injection system to said reactor enclosure.

20. The method of claim 18, further comprising the steps of establishing a target solids level for said particle storage means, sensing a solids level within said particle storage means, comparing said target solids level with said sensed solids level, and controlling the solids level within said particle storage means based upon said comparison by regulating a flow of solids from said secondary particle separator through said solids transport system to said particle storage means.

21. The method of claim 18, further comprising the steps of establishing a target solids level for a hopper located at a lower portion of said secondary particle collector, sensing a solids level within said hopper, comparing said target hopper solids level with said sensed hopper solids level, and purging solids from said hopper if said sensed hopper solids level is above said target hopper solids level, if there is no demand for solids to increase the solids level in said storage means, and if there is no demand to increase the recirculation rate of solids into said reactor.

22. The method of claim 21, further comprising the step of not purging solids from said hopper when said sensed hopper solids level is below said target hopper solids level.

* * * * *